US006409850B1

(12) United States Patent
O'Driscoll et al.

(10) Patent No.: US 6,409,850 B1
(45) Date of Patent: Jun. 25, 2002

(54) FLUXING AGENTS FOR THE REFLOWING OF ELECTRO-DEPOSITED TINPLATE

(76) Inventors: Cavan Hugh O'Driscoll, 61 East View, Barlby Road, Selby, North Yorkshire Y08 7BA (GB); Himashu Sohda, 2 Coppicewood Grove, Lidget Green, Bradford, West Yorkshire BD7 2JB (GB); Michael Lancaster, Orchard House, Sands Lane, Ellerker, E. Yorks HU15 2DR (GB)

( * ) Notice: Subject to any disclaimer, the term of this patent is extended or adjusted under 35 U.S.C. 154(b) by 0 days.

(21) Appl. No.: 09/147,972

(22) PCT Filed: Sep. 15, 1997

(86) PCT No.: PCT/GB97/02498

§ 371 (c)(1),
(2), (4) Date: Nov. 3, 1999

(87) PCT Pub. No.: WO98/13538

PCT Pub. Date: Apr. 2, 1998

(Under 37 CFR 1.47)

(30) Foreign Application Priority Data

Sep. 27, 1996 (GB) ..... 9620357

(51) Int. Cl.[7] ..... C25D 11/00; C25D 5/50; C21D 9/08

(52) U.S. Cl. ..... 148/528; 148/518; 148/522; 205/226

(58) Field of Search ..... 252/79.1; 75/303; 148/23, 512, 528, 518, 522; 205/226

(56) References Cited

FOREIGN PATENT DOCUMENTS

| | | | |
|---|---|---|---|
| GB | 986586 | * | 3/1965 |
| JP | 51-14139 A | * | 2/1976 |
| JP | 59-219496 A | * | 2/1984 |
| JP | 51-25582 A | * | 5/1993 |

OTHER PUBLICATIONS

References N–P were cited on the International Search Report.*

* cited by examiner

*Primary Examiner*—Edna Wong
(74) *Attorney, Agent, or Firm*—Carmody & Torrance LLP

(57) ABSTRACT

There is disclosed a composition for use as a flux material in a tinplating process, which comprises an aqueous solution of one or more hydroxy phenyl compounds of general formula (I), wherein M=a cationic species, preferably H, substituted or unsubstituted ammonium, alkali metal, alkaline earth metal or tin; R=H, $C_1$–$C_6$ linear or branched alkyl, alkoxyl or alkenyl, or aryl (which may be substituted); m=2 or 3; n=0, 1 or 2, the composition containing from about 0.1 g/1 to saturation of said compound of general formula (I). There is also disclosed a process for treating matte tinplate and a process for tinplating using such composition.

(I)

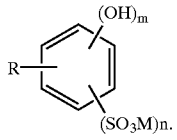

8 Claims, No Drawings

FLUXING AGENTS FOR THE REFLOWING OF ELECTRO-DEPOSITED TINPLATE

This invention concerns the improvement of the finish of electro-deposited tinplate. Specifically, the invention relates to compounds which may be used as a flux on the tinplate prior to the reflow process and ensure the production of a bright, reflective tin coating free from surface defects.

The electro-deposition of a thin coat of tin onto steel strip to impart corrosion resistance and decoration is described in detail in the book "The Technology of Tinplate" by Hoare et al., published by St. Martins Press, New York, 1965. Coiled steel strip is unwound and passed through cleaning and acid pickling stations before entering the tinplating bath where the steel strip acts as the cathode and collects a surface coat of tin with a characteristic smooth matte finish. In the subsequent process, known as flow-brightening, flow-melting or reflow, the tinplate is heated to above the melting point of the tin by the passage of an alternating current, for example, and immediately quenched. The advantages of this operation are two-fold. Firstly an iron-tin alloy layer is formed between the steel base and tin coat thereby improving corrosion resistance and secondly the matte deposit is converted to a pleasing bright reflective surface.

A serious defect which may be generated through reflow is that of "woodgrain" where the tinplate surface takes on the non-uniform appearance of longitudinally cut wood. Woodgrain is thought to be caused by localised de-wetting in areas where slow cooling allows solidification prior to quenching, see "The Origins of Woodgrain and Related Phenomenon on Tinplate", P. G. Harris and I. M. Notter, ITRI Publ. (1992), 727 (Fifth International Tinplate Conference, 1992), 56–65. If an alternating current is used to heat the plate the solid/liquid front can be periodically stationary allowing de-wetting and the production of a banded structure. Thin areas in the steel base cause localised hot spots, distorting the bands into the woodgrain swirls.

The de-wetting process itself can be influenced by tin oxide formation during reflow as described in "Woodgrain on Tinplate—How it Develops and How it can be Avoided", W. Pappert and V. Tenhaven, ITRI Publ. (1976), (First International Tinplate Conference, 1976), 83–9. These authors recommend "fluxing" the tinplate with citric acid (an antioxidant) prior to reflow to inhibit woodgrain formation. The term flux in this context refers to a substance which aids, induces or otherwise actively participates in fusing or flowing.

Other fluxes used to inhibit woodgrain include phenolsulphonic acid (Belousova et al, Stal (USSR), May 1991), naphtholdisulphonic acids (U.S. Pat. No. 5,427,677), gluconic, glutamic and tartaric acids (JP 58001085) and citrazinic, chelidamic acid, chelidonic acid and cyclohexene-1,2-dicarboxylimide (JP 60063395).

The prior art fluxes typically have low thermal stabilities and must be used in high concentrations (5 g/l and above).

The requirements of a flux are high reduction potential, high affinity for the metal and high thermal stability. In commercial operation, it is desirable that the flux retains its activity in the presence of dilute electrolyte which contains tin ions, other sulphonic acids, such as phenolsulphonic acid or toluenesulphonic acid and the like and optionally antioxidents. This is because electrolyte may be dragged from the plating bath into the fluxing bath by the moving steel strip or because it is operationally convenient to dissolve the fluxing agent in dilute electrolyte to form the fluxing bath. It is thus advantageous that fluxing agents of the present invention are compatible with different commercial electrolytes.

This invention discloses a new class of flux materials to be applied to matte tinplate prior to reflow where the flux helps achieve a uniform bright tin finish. The flux Materials are generally classified as dihydroxy or polyhydroxy phenyl compounds containing one or more sulphonic acid or sulphonate groups. They prevent the formation of surface defects and are effective at lower concentrations than prior art compounds. It has been discovered that by combining the high education potential of dihydroxybenzenes with the solubility and thermal stability imparted by sulphonic acid or sulphonate groups a class of fluxing agents is produced which strongly inhibits woodgrain formation during reflow.

Thus, the present invention includes a composition for use in a tinplating process, a method of treating tinplate prior to reflow and a method for producing bright tinplate by immersing matte tinplate into an aqueous solution of the fluxing compound, removing and drying the matte tinplate in order to generate a tinplate coated with the fluxing agent and heating the coated matte tinplate to a temperature above the melting point of the tin, but below that of the steel, and quenching to generate a bright tinplate free from woodgrain.

According to the present invention there is provided a composition for use as a flux material in a tin plating process, which comprises an aqueous solution of a hydroxy phenyl compound of the general formula:

I

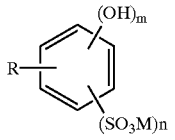

wherein:

M=A cationic species, preferably H, substituted or unsubstituted ammonium, alkali metal, alkaline earth metal or tin.

R=H, $C_1$–$C_6$ linear or branched alkyl, alkoxyl or alkenyl, or aryl (which may may be substituted)

m=2 or 3 n=1 or 2, the composition contains from about 0.1 g/l to saturation of said compound of general formula I.

The compound of formula I may be in solution in an aqueous electrolyte.

Also according to the present invention there is provided a process for treating matte tinplate prior to reflow which comprises contacting the tinplate with a composition of the invention.

The preferred method of contacting the tinplate with the composition of the invention is by immersing the tinplate in a bath of the composition.

Further, according to the present invention there is provided a process of tin plating which comprises the steps of electrolytically plating steel strip with a matte finish of tin, treating the matte tin with a composition in accordance with the present invention, drying the matte tinplate, heating the tinplate to above the melting point of tin to reflow the matte tin coating and quenching to produce a bright tin deposit. The flux is applied to the matte tinplate as an aqueous solution, the concentration of the fluxing compound in the solution being from about 0.1 g/l to saturation and preferably from about 0.6 g/l to 10 g/l, and most preferably from 1 g/l to 5 g/l.

The flux materials used in the present invention are thus about five times more efficient than naphthalenesulphonic acid compounds (recommended dose of greater than 5 g/l) and about ten times more efficient than phenolsulphonic acid (typically dosed at 10 g/l), significantly reducing costs and environmental impact. The compatibility of the novel fluxes with different electrolyte systems allows the use with different plating technologies.

Preferred Examples of fluxing compounds are:

1,2-dihydroxybenzene-4-sulphonic acid;
1,2-dihydroxybenzene-3,5-disulphonic acid;
1,2-dihydroxy-3-methylbenzene-4 or 5-sulphonic acid
1,2-dihydroxy-3-ethoxybenzene-4 or 5-sulphonic acid
1,2-dihydroxy-4-propylbenzene-5-sulphonic acid
1,2-dihydroxy-4-(2-sulphoethyl) benzene
1,3-dihydroxybenzene-4-sulphonic acid
1,3-dihydroxybenzene-4,6-disulphonic acid
1,4-dihydroxybenzene-2-sulphonic acid
1,4-dihydroxybenzene-2,5-disulphonic acid
1,3,5-trihydroxybenzene-2-sulphonic acid
1,3,5-trihydroxybenzene-2,4-disulphonic acid
1,2,3-trihydroxybenzene-4-sulphonic acid
1,2,3-trihydroxybenzene-4,6-disulphonic acid
1,2,4-trihydroxybenzene-5-sulphonic acid
1,2,4-trihydroxybenzene-3,5-disulphonic acid Especially preferred fluxing compounds are:

1,2-dihydroxybenzene-4-sulphonic acid;
1,2-dihydroxybenzene-3,5-disulphonic acid;
1,4-dihydroxybenzene-2-sulphonic acid
1,4-dihydroxybenzene-2,5-disulphonic acid The fluxing compounds may be conveniently prepared by direct sulphonation of the corresponding hydroxybenzene with oleum or sulphuric acid. The corresponding salts may be prepared by neutralisation of the sulphonation mixture with alkali, for example sodium hydroxide (M=Na); potassium hydroxide (M=K) calcium hydroxide (M=Ca); ammonia or an organic base ($M=NH_4$ or substituted $NH_4$). Alternatively some of the above compounds are available from commercial sources (see below). Fluxing compounds containing a sulphonic acid group substituted in the side chain R may be prepared by reaction of the corresponding halide with sodium sulphite and those containing a sulphato group by treatment of the corresponding alcohol with sulphuric or sulphamic acid.

In a preferred embodiment of the invention the fluxing compounds are prepared by direct sulphonation of the corresponding hydroxybenzene with sulphuric acid or oleum and the acid solution is added directly to the fluxing bath to the required concentration.

The concentration in the compositions of this invention with respect of the pure substance is 0.1 g/l to saturation and preferably 0.6 g/l to 10 g/l and most preferably from 1 g/l to 5 g/l. The compositions of the invention may contain one or more compounds of formula I and the composition may contain other ingredients, eg. dilute electrolyte.

EXAMPLE 1

1,2-Dihydroxybenzene (220g, 2 moles) are stirred with 98% sulphuric acid (240 g, 2.4 moles) at 105° C. for 1 hour. The mixture is cooled and carefully diluted with water to provide a solution containing 60% by weight of predominantly 1,2-dihydroxybenzene-4-sulphonic acid.

EXAMPLE 2

When 1,2-dihydroxybenzene in Example 1 is replaced by 1,4-dihydroxybenzene there is similarly obtained a solution of 1,4-dihydroxybenzene-2-sulphonic acid.

EXAMPLE 3

1,2-Dihydroxybenzene (110 g, 1 mole) are stirred with 20% oleum (200 g, 2.1 moles $SO_3$) at 105–110° C. for 2 hours. The mixture is cooled to 0–5° C. and carefully diluted with water, maintaining the temperature below 20° C. by external cooling, to give a solution containing 60% by weight of predominately 1,2-dihydroxybenzene-3,5-disulphonic acid.

1,2-Dihydroxybenzene-3,5-disulphonic acid disodium salt is sold under the commercial name "TIRON" (Aldrich Chemical Co) and 1,4-dihydroxybenzene-2-sulphonic acid, potassium salt, is commercially available from Lancaster Synthesis Ltd.

EXAMPLES 4–10

Steel strip was plated to a tin coating weight of 1.0 g/m$^2$ in a rotating cathode cell using a commercial electrolyte system based on phenol sulphonic acid (TABLE 1).

A second series of plates were prepared using a toluene sulphonic acid/sulphuric acid system (TABLE 2).

The matte tinplate produced was removed from the cell and immediately immersed in the fluxing solution under test and then dried in a hot air stream. The plates were flow melted by AC resistance and quenched in hot water.

The conditions were such that heavy woodgrain was experienced when no flux was employed.

TABLE 1

Phenolsulphonic Acid Electrolyte.

| EXAMPLE No. | FLUX | CONCENTRATION OF COMPOUND OF FORMULA I g/l | RESULTS |
|---|---|---|---|
| Control A | Phenol sulphonic acid | 100 | Large areas of woodgrain. |
| 4 | Product of Example 1 | 1 | No woodgrain, bright and uniform. |
| 5 | Product of Example 2 | 1 | No woodgrain, bright and uniform. |
| 6 | Product of Example 3 | 1 | No woodgrain, bright and uniform. |

TABLE 2

Toluenesulphonic Acid/Sulphuric Acid electrolyte.

| EXAMPLE No. | FLUX | CONCENTRATION OF COMPOUND OF FORMULA I g/l | RESULTS |
|---|---|---|---|
| Control B | Toluene sulphonic acid | 1.0 | Large areas of woodgrain. |
| 7 | Product of Example 3 | 0.5 | Bright with slight woodgrain. |
| 8 | Product of Example 3 | 1.0 | Bright and uniform |

TABLE 2-continued

Toluenesulphonic Acid/Sulphuric Acid electrolyte.

| EXAMPLE No. | FLUX | CONCENTRATION OF COMPOUND OF FORMULA I g/l | RESULTS |
|---|---|---|---|
| | | | with no woodgrain. |
| 9 | Product of Example 2 | 1.0 | Bright and uniform with no woodgrain. |
| 10 | "TIRON" | 1.0 | Bright and uniform with no woodgrain. |

The trials were repeated where the fluxing solutions were included 20 g/l of aqueous electrolyte to simulate commercial operation where the electrolyte is dragged into the fluxing bath by the moving steel strip.

The results were unaffected by this treatment.

What is claimed is:

1. A process for treating matte tinplate prior to reflow, which process comprises contacting the tinplate with a composition comprising an aqueous solution of one or more hydroxy phenyl compounds of the following structure:

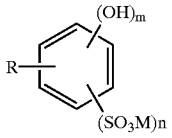

wherein:

M is a cationic species selected from the group consisting of hydrogen, substituted or unsubstituted ammonium, alkali metal, alkaline earth metal and tin;

R is a substituent selected from the group consisting of hydrogen, $C_1$–$C_6$ linear or branched alkyl, alkoxyl, alkenyl, and aryl;

m is 2 or 3; and n is 1 or 2.

2. A process according to claim 1, in which the hydroxy phenyl compounds are selected from the group consisting of 1,2-dihydroxybenzene-4-sulphonic acid;

1,2-dihydroxybenzene-3,5-disulphonic acid;
1,2-dihydroxy-3-methylbenzene-4 or 5-sulphonic acid;
1,2-dihydroxy-3-ethoxybenzene-4 or 5-sulphonic acid;
1,2dihydroxy-4-propylbenzene-5-sulphonic acid;
1,2-dihydroxy4 -(2-sulphoethyl) benzene;
1,3-dihydroxybenzene-4-sulphonic acid;
1,3-dihydroxybenzene-4,6-disulphonic acid;
1,4-dihydroxybenzene-2-sulphonic acid;
1,4-dihydroxybenzene-2,5-sulphonic acid;
1,3,5-trihydroxybenzene-2-sulphonic acid;
1,3,5-trihydroxybenzene-2,4-disulphonic acid;
1,2,3-trihydroxybenzene-4-sulphonic acid;
1,2,3-trihydroxybenzene-4,6-disulphonic acid;
1,2,4-trihydroxybenzene-5-sulphonic acid, and
1,2,4-trihydroxybenzene-3,5-sulphonic acid.

3. A process according to claim 2 wherein the composition comprises from 0.6 g/l to 10 g/l of the hydroxy phenyl compounds.

4. A process according to claim 3 wherein the process further comprises, subsequent to contacting the tinplate with the composition, heating the tinplate to above the melting point of tin to reflow the tinplate and thereafter cooling the tinplate to below the melting point of tin.

5. A process according to claim 2, wherein the process further comprises, subsequent to contacting the tinplate with the composition, heating the tinplate to above the melting point of tin to reflow the tinplate and thereafter cooling the tinplate to below the melting point of tin.

6. A process according to claim 1 wherein the composition comprises from 0.6 g/l to 10 g/l of the hydroxy phenyl compounds.

7. A process according to claim 1 wherein the composition comprises from 1 g/l to 5 g/l of the hydroxy phenyl compounds.

8. A process according to claim 1 wherein the process further comprises, subsequent to contacting the tinplate with the composition, heating the tinplate to above the melting point of tin to reflow the tinplate and thereafter cooling the tinplate to below the melting point of tin.

* * * * *

UNITED STATES PATENT AND TRADEMARK OFFICE

CERTIFICATE OF CORRECTION

PATENT NO. : 6,409,850 B1
DATED : June 25, 2002
INVENTOR(S) : Cavan H. O'Driscoll et al.

It is certified that error appears in the above-identified patent and that said Letters Patent is hereby corrected as shown below:

Title page,
Item [57], ABSTRACT,
Line 8, delete "n=0, 1 or 2" and replace it with -- n=1 or 2 --

Signed and Sealed this

Third Day of December, 2002

JAMES E. ROGAN
*Director of the United States Patent and Trademark Office*